US011482107B2

(12) United States Patent
Yabushita et al.

(10) Patent No.: US 11,482,107 B2
(45) Date of Patent: Oct. 25, 2022

(54) INFORMATION PROCESSING APPARATUS, OPERATION MANAGEMENT SYSTEM, AND NON-TRANSITORY STORAGE MEDIUM

(71) Applicant: TOYOTA JIDOSHA KABUSHIKI KAISHA, Toyota (JP)

(72) Inventors: Hiroki Yabushita, Toyota (JP); Keiichi Kondo, Chiryu (JP); Kaori Takahashi, Nagoya (JP); Xin Jin, Nagoya (JP); Daisuke Mizushima, Toyota (JP); Satoru Ando, Nagoya (JP); Takeshi Murakami, Okazaki (JP); Yuchi Yamanouchi, Toyota (JP); Kenta Miyahara, Toyota (JP); So Sawahira, Toyota (JP); Rina Mukai, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 35 days.

(21) Appl. No.: 17/114,816

(22) Filed: Dec. 8, 2020

(65) Prior Publication Data

US 2021/0174680 A1 Jun. 10, 2021

(30) Foreign Application Priority Data

Dec. 9, 2019 (JP) ..... JP2019-222448

(51) Int. Cl.

| | |
|---|---|
| ***G08G 1/123*** | (2006.01) |
| ***G08G 1/133*** | (2006.01) |
| ***G06Q 50/30*** | (2012.01) |
| ***G07B 15/02*** | (2011.01) |

(52) U.S. Cl.
CPC ..... *G08G 1/133* (2013.01); *G06Q 50/30* (2013.01); *G07B 15/02* (2013.01)

(58) Field of Classification Search
CPC ..... G08G 1/133; G08G 1/166; G08G 1/167; G08G 1/202; G08G 1/123; G06Q 50/30; G06Q 10/04; G07B 15/02
See application file for complete search history.

(56) References Cited

U.S. PATENT DOCUMENTS

| | | | | |
|---|---|---|---|---|
| 7,869,939 | B2 * | 1/2011 | Kikuchi | G08G 1/13 701/423 |
| 9,441,981 | B2 * | 9/2016 | Abhyanker | H04W 4/02 |
| 2006/0074545 | A1 * | 4/2006 | Kim | G08G 1/123 340/994 |

FOREIGN PATENT DOCUMENTS

JP 2007-264875 A 10/2007

* cited by examiner

*Primary Examiner* — Toan N Pham
(74) *Attorney, Agent, or Firm* — Sughrue Mion, PLLC

(57) ABSTRACT

An information processing apparatus is provided with a controller comprising at least one processor configured to perform: obtaining route information indicating an operation route of a vehicle utilized by unspecified users; and obtaining desired location information indicating desired locations at which the users desire to get on the vehicle or desired locations at which the users desire to get off the vehicle. Then, the controller of the information processing apparatus determines a stop location, at which the vehicle is stopped for the users to get on or off, based on a plurality of pieces of the desired location information and the route information, and presents stop location information indicating the stop location thus determined to the users.

20 Claims, 10 Drawing Sheets

INFORMATION PROCESSING APPARATUS, OPERATION MANAGEMENT SYSTEM, AND NON-TRANSITORY STORAGE MEDIUM

CROSS REFERENCE TO THE RELATED APPLICATION

This application claims the benefit of Japanese Patent Application No. 2019-222448, filed on Dec. 9, 2019, which is hereby incorporated by reference herein in its entirety.

BACKGROUND

Technical Field

The present disclosure relates to an information processing apparatus, an operation management system, and a non-transitory storage medium.

Description of the Related Art

Patent literature 1 discloses an operation management system that receives operation status information from an in-vehicle device installed in a bus, and transmits the received operation status information from a bus management center to each bus stop thereby to display an operation status of the bus on a display panel of each bus stop.

CITATION LIST

Patent Literature

Patent Literature 1: Japanese Patent Application Laid-Open Publication No. 2007-264875

SUMMARY

An object of the present disclosure is to provide a technique for improving the convenience of users in a vehicle utilized by unspecified users.

An information processing apparatus according to one aspect of the present disclosure includes a controller comprising at least one processor configured to perform:

obtaining route information indicating an operation route of a vehicle utilized by a plurality of users;

obtaining desired location information indicating respective desired locations at which the plurality of users desire to get on the vehicle or respective desired locations at which the plurality of users desire to get off the vehicle;

determining a stop location at which the vehicle stops for the users to get on or off the vehicle, based on a plurality of pieces of the desired location information by the plurality of users and the route information; and presenting stop location information indicating the stop location thus determined to the users.

An operation management system according to another aspect of the present disclosure includes:

an in-vehicle device mounted on a vehicle; and a management server configured to manage an operation of the vehicle by communicating with the in-vehicle device;

wherein the in-vehicle device or the management server includes a controller comprising at least one processor configured to perform:

obtaining route information indicating an operation route of the vehicle utilized by a plurality of users;

obtaining desired location information indicating respective desired locations at which the plurality of users desire to get on the vehicle or respective desired locations at which the plurality of users desire to get off the vehicle;

determining a stop location at which the vehicle stops for the users to get on or off the vehicle, based on a plurality of pieces of the desired location information by the plurality of users and the route information; and presenting stop location information indicating the stop location thus determined to the users.

A non-transitory storage medium according to a further aspect of the present disclosure stores a program that causes a computer to perform:

obtaining route information indicating an operation route of a vehicle utilized by a plurality of users;

obtaining desired location information indicating respective desired locations at which the plurality of users desire to get on the vehicle or respective desired locations at which the plurality of users desire to get off the vehicle;

determining a stop location at which the vehicle stops for the users to get on or off the vehicle, based on a plurality of pieces of the desired location information by the plurality of users and the route information; and presenting stop location information indicating the stop location thus determined to the users.

According to the present disclosure, it is possible to improve the convenience of users in a vehicle utilized by unspecified users.

DESCRIPTION OF THE EMBODIMENTS

Figure 1:
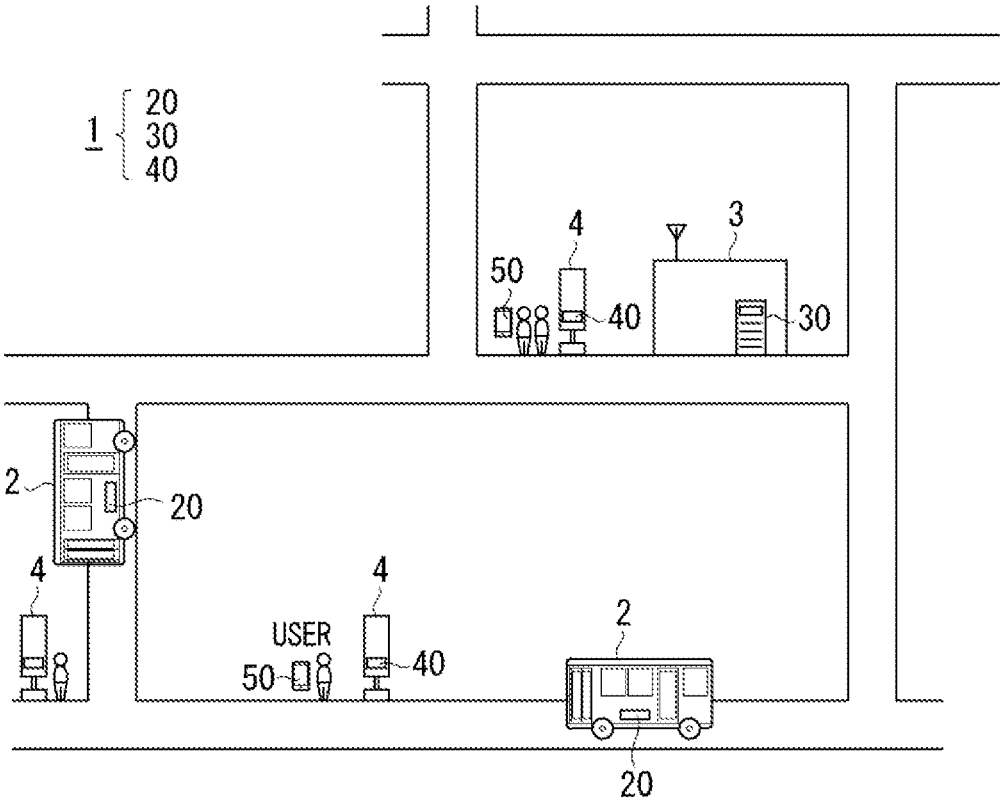
FIG. 1 is a block diagram illustrating a schematic configuration of an operation management system.

Route buses travel along predetermined operation routes, and stop at predetermined bus stops, so that passengers (users) are allowed to get on and off. In general, bus stops for a route bus have been determined in advance, so that when a destination of a user is far from a nearby bus stop, the distance that the user moves to the destination after getting off the route bus becomes long. In particular, in cases where the destination is located at an intermediate point between adjacent bus stops, even if the route bus travels near the destination, the user cannot get off the bus at this location, and thus there is a problem that the user will move excessively from the nearby bus stop to the destination.

On the other hand, some vehicles such as share-ride taxies, in which a small number of passengers can ride, adopt a system that allows users to get on and off at any optional locations on a predetermined operation route without defining fixed stops. In this case, as the number of users increases, the time for the users to get on and off such a vehicle increases, and hence, as the number of passengers increases, the time taken to get on and off will excessively increase, and the operation efficiency of the vehicle will decrease. In addition, the time required for the vehicle operation will vary depending on the number of passengers, so that the arrival time of the vehicle cannot be predicted, and user convenience will be reduced.

An information processing apparatus according to the present disclosure includes a controller comprising at least one processor that performs the processing of obtaining route information indicating an operation route of a vehicle utilized by a plurality of users. The controller obtains desired location information indicating desired locations at which the plurality of users desire to get on the vehicle or desired locations at which the plurality of users desire to get off the vehicle. Further, the controller determines a stop location at which the vehicle is stopped for the users to get on or off, based on a plurality of pieces of the desired location information by the plurality of users and the route information, and presents stop location information indicating the stop location thus determined to the users.

With such a configuration, the information processing apparatus of the present disclosure can determine a stop location of the vehicle so as to be closer to the individual desired locations based on a plurality of pieces of desired location information by individual users, thereby improving the convenience of the users.

The information processing apparatus may be an in-vehicle device mounted on a vehicle. Also, the information processing apparatus may be a management server that is provided in a management center and manages the operation of the vehicle by notifying an in-vehicle device at the vehicle side of the determined stop location. The vehicle is, for example, a motor vehicle that travels on a road, a railroad, a track or the like with people (users) carried thereon. The vehicle is not limited to this, but may be a railroad vehicle traveling on a railway or a tracked vehicle traveling on a track. The tracked vehicle may include a vehicle for a subway or a vehicle for a new traffic system. The vehicle in this embodiment is used by a plurality of unspecified users as public transportation, for example, and may be a route bus, a share-ride taxi, or a streetcar. In addition, the vehicle is not limited to a vehicle of a public transportation, but may be a vehicle used for transportation in a hotel, transportation in a commercial facility, commuting to a specific company, or the like. In this case, the users may be users of a specific organization such as hotel guests, users of a commercial facility, or employees of a company. In this embodiment, the plurality of users may be, for example, users for whom at least their get-on or get-off locations have not yet been specified when the operation route of the vehicle is determined or when the information processing apparatus obtains the operation route. The operation route is a route on which a vehicle such as for example a route bus is scheduled to travel. In the operation route, a stop location such as a bus stop at which the vehicle is scheduled to stop (a predetermined stop location) may be determined. Further, a scheduled time at which the vehicle stops at the predetermined stop location may be determined.

The controller may classify a plurality of the desired locations into groups, the number of which does not exceed an upper limit value, based on mutual distances between the desired locations, and determine one stop location for each group.

The controller may determine the upper limit value based on the number of users utilizing the vehicle, the road condition of the operation route, or the condition of delay with respect to an operation schedule of the vehicle, in addition to the route information and the plurality of pieces of desired location information.

When a first user, who is one of the plurality of users, desires to get on the vehicle, the controller may obtain, from a user terminal of the first user, starting point information indicating a starting point from which the first user goes to the vehicle in order to get on the vehicle, and may obtain a location on the operation route closest to the starting point as a desired location of the first user.

When a second user, who is one of the plurality of users, desires to get off the vehicle, the controller may obtain, from a user terminal of the second user, destination information indicating a destination point to which the second user goes after getting off the vehicle, and may obtain a location on the operation route closest to the destination point as a desired location of the second user.

The controller may set a priority to each of the desired locations indicated by the plurality of pieces of desired location information, and may determine one of the stop locations based on the priority in addition to the route information and the plurality of pieces of desired location information.

The controller may perform the calculation of the fare of a third user, who is one of the plurality of users, based on the distance from a get-on location at which the third user has gotten on the vehicle to a get-off location at which the third user has gotten off the vehicle.

The controller may adjust the fare in accordance with a distance between the desired location desired by the third user and the stop location.

The controller may calculate a score of an incentive to be issued to a fourth user, who is one of the plurality of users, based on a distance between the desired location desired by the fourth user and the stop location.

An operation management system according to the present disclosure includes an in-vehicle device mounted on a vehicle, and a management server configured to communicate with the in-vehicle device so as to manage an operation of the vehicle, wherein the in-vehicle device or the management server includes the information processing apparatus.

One aspect of the present disclosure is a vehicle that includes a traveling device configured to drive wheels to travel, and the information processing apparatus.

A control method according to the present disclosure comprises the steps of: obtaining route information indicating an operation route of a vehicle utilized by a plurality of users; obtaining desired location information indicating respective desired get-on locations at which the plurality of users desire to get on the vehicle or respective desired get-off locations at which the plurality of users desire to get off the vehicle; determining a stop location at which the vehicle is stopped for the users to get on or get off the vehicle, based on a plurality of pieces of the desired location information by the plurality of users and the route information; and presenting stop location information indicating the stop location thus determined to the users; wherein a computer performs the above-mentioned steps.

Another aspect of the present disclosure is a program for causing a computer to perform the respective steps of the control method. A further aspect of the present disclosure is a storage medium configured to store the program in a non-transitory manner.

First Embodiment

Hereinafter, an operation management system including an information processing apparatus according to a first embodiment of the present invention will be described with reference to the accompanying drawings. FIG. 1 is a block diagram illustrating a schematic configuration of the operation management system. The operation management system 1 includes an in-vehicle device 20 provided in each vehicle (bus) 2, a management server 30 provided in a bus management center 3, and a bus stop terminal 40 provided in each bus stop 4. Here, note that in the present embodiment, the operation management system 1 has a configuration that does not include user terminals 50, but may include user terminals 50. In addition, the operation management system 1 may be a configuration that includes the in-vehicle devices 20 and the management server 30, but does not include the bus stop terminals 40.

Figure 2:
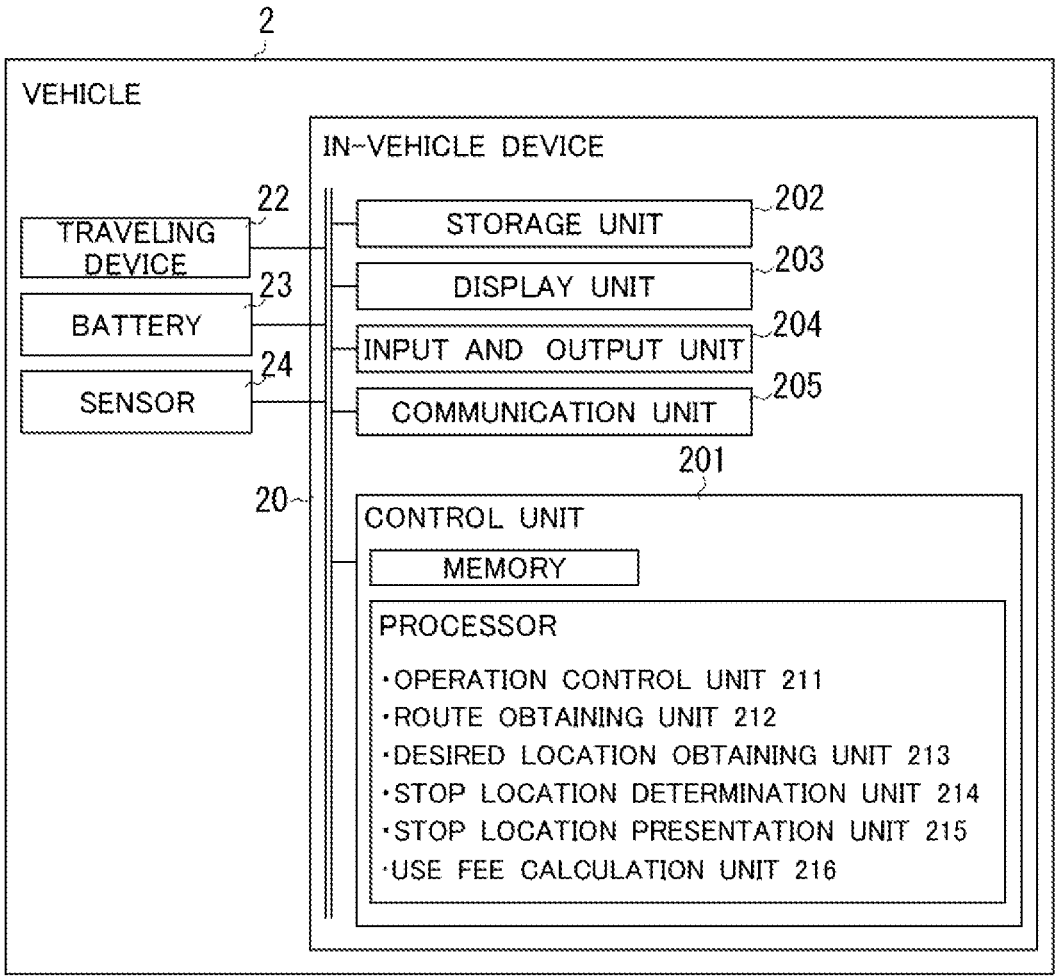
FIG. 2 is a block diagram illustrating a schematic configuration of a vehicle.

FIG. 2 is a block diagram illustrating a schematic configuration of a vehicle 2. As illustrated in FIG. 2, the vehicle 2 includes an in-vehicle device (information processing apparatus) 20, a traveling device 22, a battery 23, and a sensor 24.

The traveling device 22 is a mechanism that causes the vehicle 2 to travel, and includes a power source such as an internal combustion engine or a motor, a generator, a transmission mechanism, a braking mechanism, a steering mechanism, and the like.

As the transmission mechanism, there is mentioned a transmission that transmits a driving force generated by a power source to wheels while changing a torque, a rotation speed and a rotation direction thereof thereby to drive the wheels. Here, note that the wheels may each be configured to be directly driven by a power source such as a wheel-in motor, without using a transmission mechanism.

The battery 23 supplies electric power to respective parts of the vehicle 2, such as the in-vehicle device 20, the traveling device 22, and the sensor 24. As the battery 23, there may be adopted various types of batteries such as a battery that stores electric power generated by a generator of the traveling device 22, a battery that stores electric power when connected to an external commercial power supply, or a fuel cell that generates electric power by using fuel such as hydrogen.

The sensor 24 comprises at least one of a vehicle speed sensor, an acceleration sensor, an azimuth sensor, a rainfall sensor, a temperature sensor, an obstacle sensor, a position sensor, and the like, and detects at least one of a state of an own vehicle and a surrounding state thereof. The obstacle sensor may be a camera, a radar, an LiDAR (Laser Imaging Detection and Ranging), or the like. The position sensor is a sensor that detects the current position or location of the own vehicle. The position sensor may be, for example, a positioning device in a satellite positioning system such as a GPS receiver.

The in-vehicle device 20 controls respective parts of the vehicle 2 such as the traveling device 22 and so on. For example, the in-vehicle device 20 causes the vehicle 2 to travel autonomously according to an operation route received from the management server 30. That is, the vehicle 2 is an autonomous vehicle that travels under the control of the in-vehicle device 20. Here, note that the vehicle 2 is not limited to an autonomous vehicle, but may be a vehicle that is manually driven by a driver based on an operation route and/or a stop location presented by the in-vehicle device 20.

The in-vehicle device 20 is a computer mounted on the vehicle 2, and includes a control unit 201, a storage unit 202, a display unit 203, an input and output unit 204, and a communication unit 205.

The control unit 201 controls the overall operation of the in-vehicle device 20, and implements various functions of the in-vehicle device 20. The control unit 201 includes, for example, a processor and a memory. The processor controls the operation of the in-vehicle device 20 in a comprehensive manner. The processor is also referred to as a CPU, an MPU, or the like. The memory is, for example, a ROM and a RAM. The ROM is a storage medium that stores various programs or data. The RAM is a storage medium that temporarily stores the various programs or data. The RAM may be made directly accessible from the processor, so that it may function as a main memory.

The storage unit 202 is a storage device such as an HDD, an SSD, or the like. The storage unit 202 functions as an external storage device of the control unit 201. The storage unit 202 stores map information, route information, information set by an administrator, and so on. The display unit 203 is a unit that displays information, and is, for example, a liquid crystal display device, an organic EL display device, or the like. The display unit 203 may be a display device that is provided in the vehicle and performs display to passengers in the vehicle, or may be an external display device that is provided outside the vehicle and performs display to people outside the vehicle.

The input and output unit 204 is a unit that inputs and outputs information to and from the control unit 201, and is, for example, a unit that receives an operation from a user and outputs information to the user, and is, for example, a button, a keyboard, a touch panel, a display unit, a speaker, or the like. The communication unit 205 is a communication interface for communicating with an external device. The communication unit 205 may include a plurality of communication interfaces such as a communication interface that performs direct communication with another vehicle, a communication interface that performs communication via a communication network, and so on. As the communication interface that performs direct communication with another vehicle, there is mentioned a communication interface that performs communication using Bluetooth (registered trademark), ZigBee (registered trademark), or an ad hoc mode of WiFi. In addition, the communication unit 205 may be a communication interface that performs communication using a business-use radio (simple radio).

In the control unit 201, the processor executes a program stored in the ROM, the storage unit 202 or the like, by using the RAM as a work area. By executing this program, the control unit 201 functions as functional units such as a driving control unit 211, a route obtaining unit 212, a desired location obtaining unit 213, a vehicle stop location determination unit 214, a vehicle stop location presentation unit 215, and so on. The control unit 201 may achieve the functions of these functional units by a plurality of processors or a plurality of cores included in a single processor. Also, the control unit 201 may achieve the functions of these functional units by a single processor using a technique such as multitasking or multithreading.

The driving control unit 211 processes information obtained via the sensor 24 or the input and output unit 204, and performs control for causing the vehicle 2 to travel autonomously from a current location toward a destination. For example, when the route information is obtained from the management server 30, the driving control unit 211 causes the vehicle 2 to travel from a starting point to an arrival point (destination) according to an operation route indicated by the route information. That is, the driving control unit 211 controls the steering mechanism so as to change a lane on which the vehicle travels, and autonomously performs control such as starting or stopping the vehicle according to a traffic signal, adjusting the traveling speed according to a speed limit and/or the speed of a surrounding vehicle, and/or avoiding an obstacle.

The route obtaining unit 212 obtains route information indicating an operation route of the vehicle 2. For example, the route obtaining unit 212 communicates with the management server 30 of the bus management center 3 via a network, and receives route information. Also, the route obtaining unit 212 may read out from the storage unit 202 the route information that has been stored in advance in the storage unit 202.

The desired location obtaining unit 213 obtains desired location information indicating a desired location at which the user desires to get on the vehicle 2 or a desired location at which the user desires to get off the vehicle 2. The desired location obtaining unit 213 may be connected to the user terminal 50 via a radio or wireless communication line, and may receive the desired location information from the user terminal 50. The desired location obtaining unit 213 may receive, from the user terminal 50, information (starting point information) of a point (starting point), such as a user's home or workplace, at which the user starts moving to a get-on location so as to get on the vehicle 2, and may set a location on the operation route closest to the starting point as the desired location of the user. In addition, the desired location obtaining unit 213 may receive, from the user terminal 50, information (destination information) of a point (destination point) to which the user will go after getting off the vehicle 2, and may set a location on the operation route closest to the destination point as the desired location of the user. That is, the desired location obtaining unit 213 may receive starting point information or destination point information from the user terminal 50, obtain a desired location from the starting point information or the destination point information, and obtain information indicating this desired location as the desired location information. Moreover, the desired location obtaining unit 213 stores the desired location information and a user ID in the storage unit 202 in association with each other.

The stop location determination unit 214 determines stop locations at which the vehicle is stopped in order for the user to get on or off the vehicle, based on the plurality of pieces of desired location information and the route information. In the present embodiment, the stops 4 have been set in advance at predetermined locations on the operation route, and if there is at least one user getting on or off at a stop 4, the vehicle will always stop at this stop. In addition, when a user desires to get on and off between adjacent stops, the location of stopping is determined so that the vehicle temporarily stops at this desired location of the user at the number of times equal to or less than an upper limit value. For example, the stop location determination unit 214 sets the number of times of stop to be equal to or less than the upper limit value by determining one stop location from a plurality of desired locations. The stop location determination unit 214 may determine the upper limit value of the number of times of stop based on the number of users or the condition of delay, in addition to the plurality of pieces of desired location information and the route information.

The stop location presentation unit 215 presents stop location information indicating the stop location thus determined to the user. For example, the stop location presentation unit 215 presents the stop location to the user by displaying the stop location on a display device provided in the vehicle, or by outputting a voice message indicating the stop location, or by transmitting and displaying the stop location information to and on the user terminal 50.

The use fee calculation unit 216 obtains, adjusts, and presents the fare of the user. For example, the use fee calculation unit 216 presents the fare to the user by displaying the fare on a display device provided in the vehicle, or by outputting a voice message indicating the fare, or by transmitting and displaying the information on the fare to and on the user terminal 50.

Figure 3:
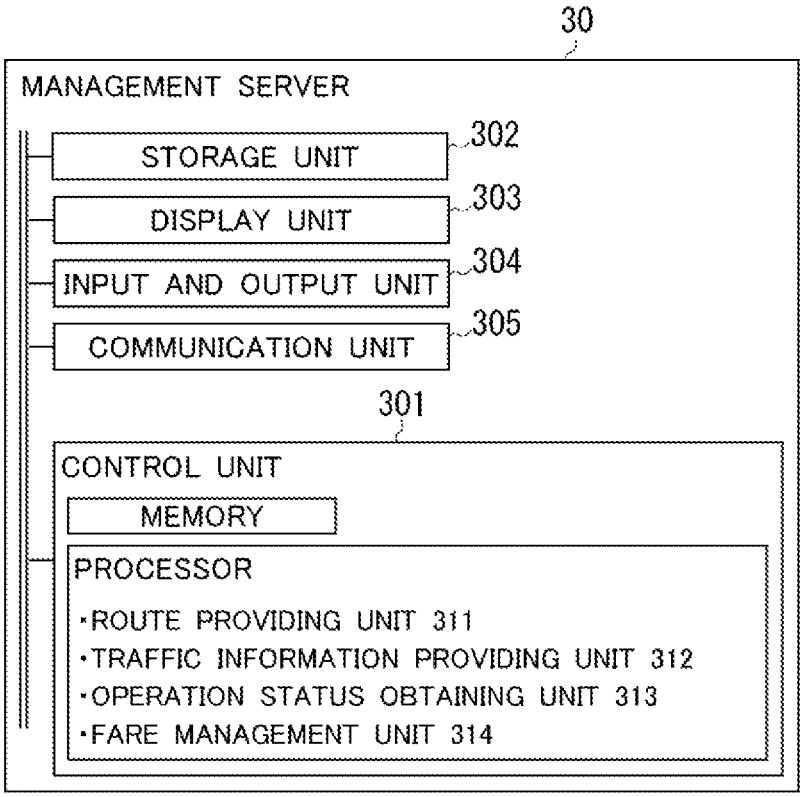
FIG. 3 is a block diagram illustrating a schematic configuration of a management server.

FIG. 3 is a block diagram illustrating a schematic configuration of the management server 30. The management server 30 is a computer provided in the operation management center, and includes a control unit 301, a storage unit 302, a display unit 303, an input and output unit 304, and a communication unit 305.

The control unit 301 controls the overall operation of the management server 30 and implements various functions of the management server 30. The control unit 301 includes, for example, a processor and a memory. The processor comprehensively controls the operation of the management server 30. The processor is also referred to as a CPU, an MPU, or the like. The memory is, for example, a ROM and a RAM. The ROM is a storage medium that stores various programs or data. The RAM is a storage medium that temporarily stores various programs or data. The RAM may be made directly accessible from the processor, so that it may function as a main memory.

The storage unit 302 is a storage device such as an HDD, an SSD, or the like. The storage unit 302 functions as an external storage device of the control unit 301. The storage unit 302 stores map information, route information, information set by the administrator, and so on. The display unit 303 is a unit that displays information, and is, for example, a liquid crystal display device, an organic EL display device, or the like.

The input and output unit 304 is a unit that receives an operation from a user and outputs information to the user, and is, for example, a button, a keyboard, a touch panel, a display unit, a speaker, or the like. The communication unit 305 is a communication interface for communicating with an external device. The communication unit 305 may include a plurality of communication interfaces such as a communication interface that performs direct communication with another vehicle, a communication interface that performs communication via a communication network, and so on. As the communication interface that performs direct communication with another vehicle, there is mentioned a communication interface that performs communication using Bluetooth (registered trademark), ZigBee (registered trademark), or an ad hoc mode of WiFi. In addition, the communication unit 305 may be a communication interface that performs communication using a business-use radio (simple radio).

In the control unit 301, the processor executes a program stored in the ROM, the storage unit 302 or the like, by using the RAM as a work area. By executing this program, the control unit 301 functions as functional units such as a route providing unit 311, a traffic information providing unit 312, an operation status obtaining unit 313, a fare management unit 314, and so on. The control unit 301 may achieve the functions of these functional units by a plurality of processors or a plurality of cores included in a single processor. Also, the control unit 301 may achieve the functions of these functional units by a single processor using a technique such as multitasking or multithreading.

The route providing unit 311 is connected to the in-vehicle device 20 via a radio communication line or channel, and transmits route information of the vehicle 2 on which the in-vehicle device 20 is mounted.

The traffic information providing unit 312 provides the in-vehicle device 20 with information on traffic, such as information on traffic congestion, road regulation, a distance between the vehicle 2 and each of preceding and following buses (vehicles) 2, weather, or the like.

The operation status obtaining unit 313 obtains information on the current location and the stop location of the vehicle 2 from the in-vehicle device 20 in real time.

The fare management unit 314 obtains the fare information of each user from the in-vehicle device 20, and stores the fare of each user and the number of passengers at each stop location.

Figure 4:
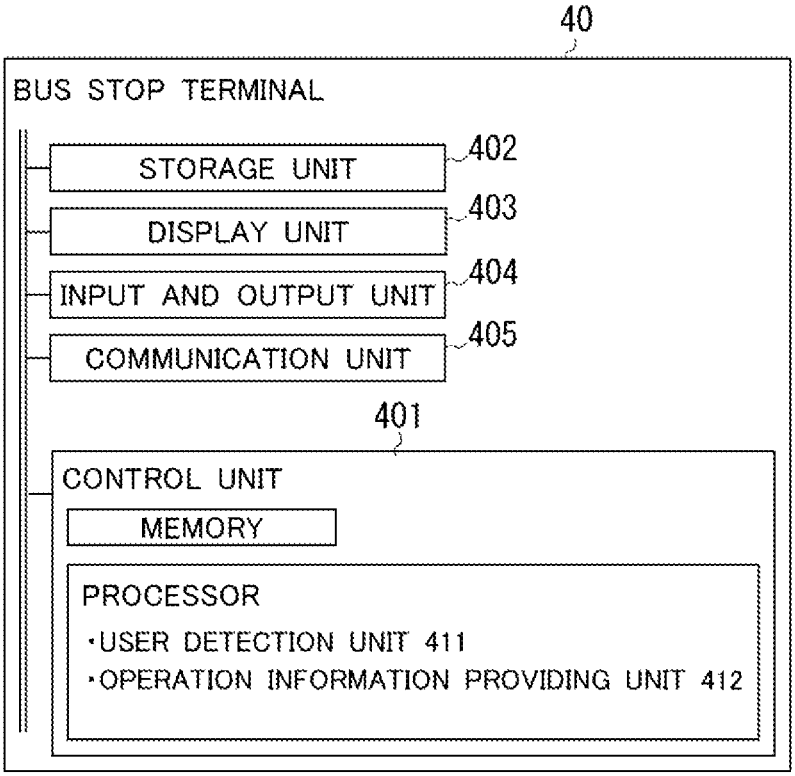
FIG. 4 is a block diagram illustrating a schematic configuration of a bus stop terminal.

FIG. 4 is a block diagram illustrating a schematic configuration of each bus stop terminal 40. The bus stop terminal 40 is a computer provided in the operation management center, and includes a control unit 401, a storage unit 402, a display unit 403, an input and output unit 404, and a communication unit 405.

The control unit 401 controls the operation of the entire bus stop terminal 40, and implements various functions of the bus stop terminal 40. The control unit 401 includes, for example, a processor and a memory. The processor comprehensively controls the operation of the bus stop terminal 40. The processor is also referred to as a CPU, an MPU, or the like. The memory is, for example, a ROM and a RAM. The ROM is a storage medium that stores various programs or data. The RAM is a storage medium that temporarily stores various programs or data. The RAM may be made directly accessible from the processor, so that it may function as a main memory.

The storage unit 402 is a storage device such as an HDD, an SSD, or the like. The storage unit 402 functions as an external storage device of the control unit 401. The storage unit 402 stores map information, route information, information set by the administrator, and so on. The display unit 403 is a unit that displays information, and is, for example, a liquid crystal display device, an organic EL display device, or the like. The display unit 403 may be a display device that is provided in the vehicle and performs display to passengers in the vehicle, or may be an external display device that is provided outside the vehicle and performs display to people outside the vehicle.

The input and output unit 404 is a unit that inputs and outputs information of users or the like, and is, for example, a human sensor, a camera, an IC chip reader, a display device, a speaker, or the like. The communication unit 405 is a communication interface for communicating with an external device. The communication unit 405 may include a plurality of communication interfaces such as a communication interface that performs direct communication with another vehicle, a communication interface that performs communication via a communication network, and so on. As the communication interface that performs direct communication with another vehicle, there is mentioned a communication interface that performs communication using Bluetooth (registered trademark), ZigBee (registered trademark), or an ad hoc mode of WiFi. In addition, the communication unit 305 may be a communication interface that performs communication using a business-use radio (simple radio).

In the control unit 401, the processor executes a program stored in the ROM, the storage unit 402 or the like, by using the RAM as a work area. By executing this program, the control unit 401 functions as functional units such as a user detection unit 411, an operation information presentation unit 412, and so on. The control unit 401 may achieve the functions of these functional units by a plurality of processors or a plurality of cores included in a single processor. Also, the control unit 401 may achieve the functions of these functional units by a single processor using a technique such as multitasking or multithreading.

The user detection unit 411 detects users who are waiting for the arrival of the vehicle 2 in order to get on the vehicle 2 at the stop 4 by the human sensor of the input and output unit 404. In addition, the user detection unit 411 may capture an image of the vicinity of the stop 4 by a camera, and detect people who are standing in line in front of the stop from the captured image by means of image processing.

The operation information presentation unit 412 receives operation information including a destination and an arrival time of the next vehicle 2 from the in-vehicle device 20 or the management server 30, and presents the operation information to the users by displaying the operation information on a display device.

Figure 5:
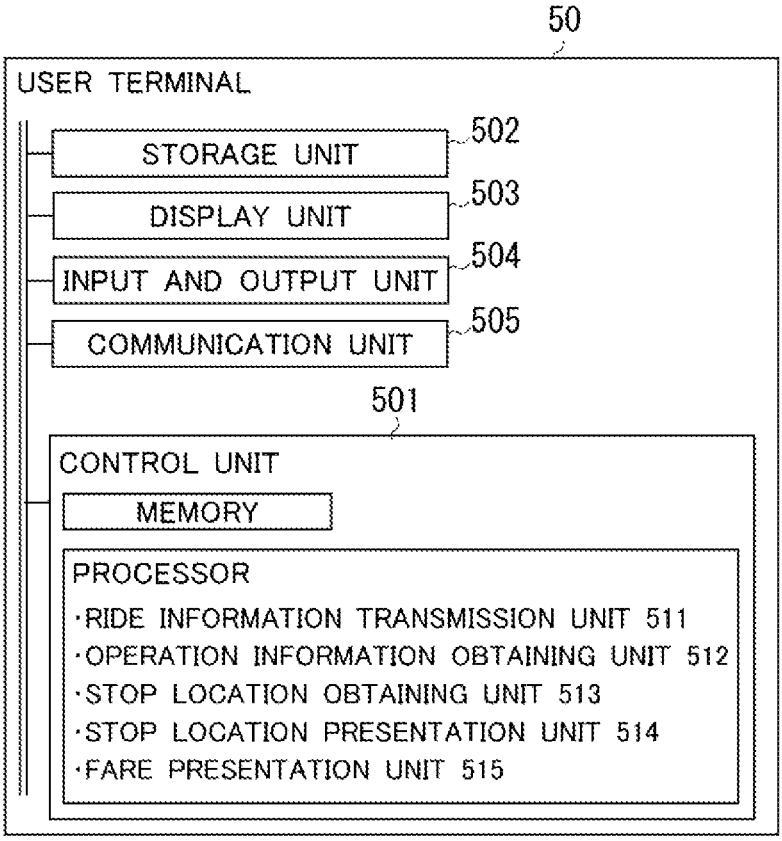
FIG. 5 is a block diagram illustrating a schematic configuration of a user terminal.

FIG. 5 is a block diagram illustrating a schematic configuration of the user terminal 50. The user terminal 50 is a computer provided in the operation management center, and includes a control unit 501, a storage unit 502, a display unit 503, an input and output unit 504, and a communication unit 505.

The control unit 501 controls the overall operation of the user terminal 50, and implements various functions of the user terminal 50. The control unit 501 includes, for example, a processor and a memory. The processor comprehensively controls the operation of the user terminal 50. The processor is also referred to as a CPU, an MPU, or the like. The memory is, for example, a ROM and a RAM. The ROM is a storage medium that stores various programs or data. The RAM is a storage medium that temporarily stores various programs or data. The RAM may be made directly accessible from the processor, so that it may function as a main memory.

The storage unit 502 is a storage device such as an HDD, an SSD, or the like. The storage unit 502 functions as an external storage device of the control unit 501. The storage unit 502 stores map information, route information, information set by the administrator, and so on. The display unit 503 is a unit that displays information, and is, for example, a liquid crystal display device, an organic EL display device, or the like. The display unit 503 may be a display device that is provided in the vehicle and performs display to passengers in the vehicle, or may be an external display device that is provided outside the vehicle and performs display to people outside the vehicle.

The input and output unit 504 is a unit that receives a user operation, and is, for example, a button, a touch panel, or the like. The communication unit 505 is a communication interface for communicating with an external device. The communication unit 505 may include a plurality of communication interfaces such as a communication interface that performs direct communication with another vehicle, a communication interface that performs communication via a communication network, and so on. As the communication interface that performs direct communication with another vehicle, there is mentioned a communication interface that performs communication using Bluetooth (registered trademark), ZigBee (registered trademark), or an ad hoc mode of WiFi.

In the control unit 501, the processor executes a program stored in the ROM, the storage unit 502 or the like, by using the RAM as a work area. By executing this program, the control unit 501 functions as functional units such as a ride information transmission unit 511, an operation information obtaining unit 512, a stop location obtaining unit 513, a stop location presentation unit 514, a fare presentation unit 515, and so on. The control unit 501 may achieve the functions of these functional units by a plurality of processors or a plurality of cores included in a single processor. Also, the control unit 501 may achieve the functions of these functional units by a single processor using a technique such as multitasking or multithreading.

The ride information transmission unit 511 transmits information indicating the starting point or the desired get-on location of the user and the destination point or the desired get-off location of the user to the in-vehicle device 20 as ride information. The ride information transmission unit 511 is not limited to being connected to the in-vehicle device 20 thereby to directly transmit the ride information to the in-vehicle device 20, but may transmit the ride information to another device such as the management server 30, the bus stop terminal 40 or the like, so that the ride information is transmitted to the in-vehicle device 20 through the another device.

The operation information obtaining unit 512 obtains operation information from another device such as the in-vehicle device 20, the management server 30, the bus stop terminal 40, or the like, and displays the operation information thus obtained such as the arrival time of the next vehicle 2 or the like on the display device to present the operation information to the user.

The stop location obtaining unit 513 obtains stop location information from the in-vehicle device 20. Here, note that the stop location obtaining unit 513 may receive the stop location information from the in-vehicle device 20 via another device such as the management server 30, the bus stop terminal 40, or the like.

When receiving the stop location information, the stop location presentation unit 514 presents the stop location to the user by displaying the stop location on the display device or outputting by voice the stop location in a voice message.

The fare presentation unit 515 obtains fare information from the in-vehicle device 20 and presents the fare information to the user. The fare presentation unit 515 may receive the fare information from the in-vehicle device 20 via another device such as the management server 30, the bus stop terminal 40, or the like. When receiving the fare information, the fare presentation unit 515 presents the fare to the user by displaying the fare on a display device or outputting the fare by voice as a voice message.

Figure 6:
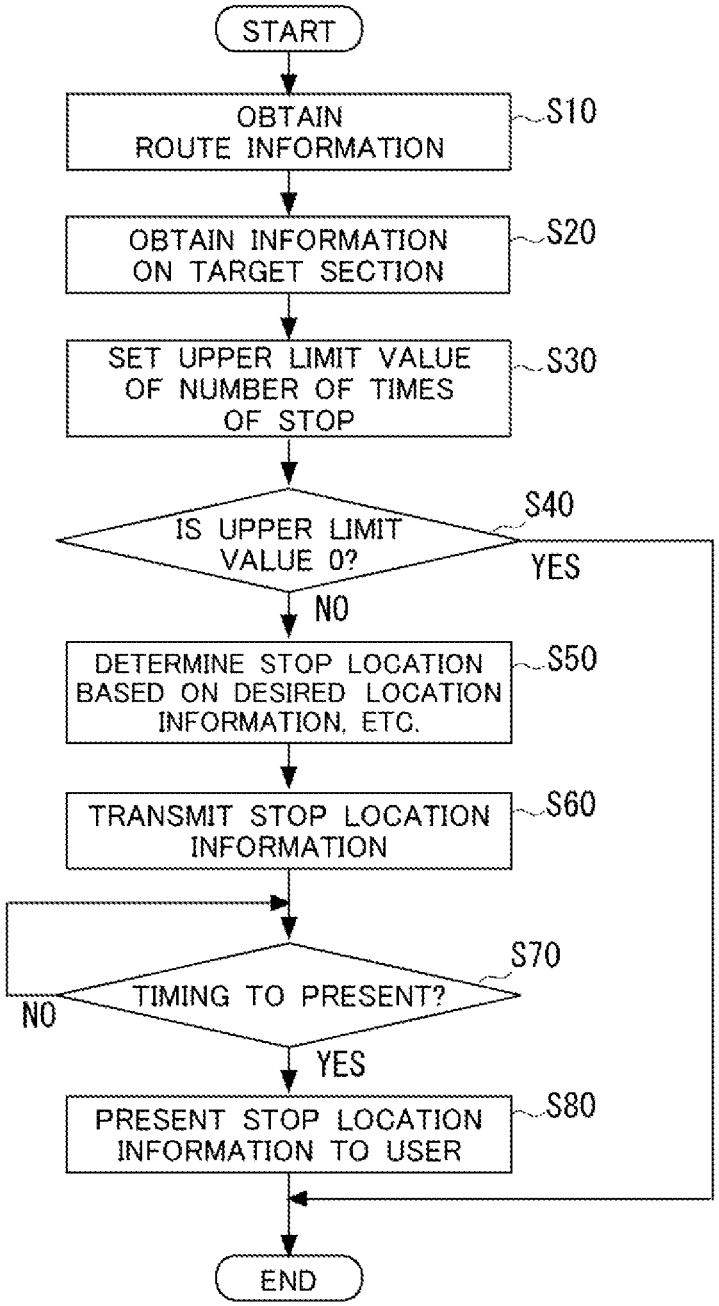
FIG. 6 is a view illustrating a flow of a control method performed by an in-vehicle device for determining a stop location.

FIG. 6 is a view illustrating a flow of a control method carried out by the in-vehicle device 20 for determining a stop location. The in-vehicle device 20 repeatedly performs the processing of FIG. 6 by executing a control program in a periodical manner.

In step S10, the in-vehicle device 20 obtains route information indicating an operation route of the vehicle from the management server 30. Here, note that when the route information has been registered in advance in the storage unit 202, the processing of step S10 may be omitted.

In step S20, the in-vehicle device 20 obtains route information, desired location information, priority information, traffic information, the number of passengers, and the condition of delay, of a section in which a stop location is determined (target section). Here, the section in which the stop location is determined is, for example, a range of the operation route divided by a predetermined condition, such as for example a section from the next stop to the following next stop, a section in which the vehicle will travel from 10 minutes after to 20 minutes after, a section from the current location to a forward location 5 km to 10 km ahead, or the like. Here, note that the desired location information has been received at any time from the user terminal 50 of each user and held in the storage unit 202 separately from the processing of FIG. 6, so that it is obtained from the storage unit 202 in step S20.

In step S30, the in-vehicle device 20 determines the upper limit value of the number of times of stop in the target section set as the processing target in step S20. For example, the upper limit value has been registered in advance in the storage unit 202 for each target section, and is read and set as the upper limit value. In addition, the in-vehicle device 20 may determine the upper limit value based on the number of users getting on and off, a road condition, weather, or a delay condition. For example, the in-vehicle device 20 has registered a maximum allowable get-on and get-off time for each target section in the storage unit 202 in advance, and obtains the upper limit value of the number of times of stop by dividing the maximum get-on and get-off time by the time required for stopping at one time for getting on and off the vehicle (one get-on and get-off time). In this case, if the number of users who get on and off the vehicle is large, it takes a large time for the users to get on and off the vehicle, and hence, the calculation of the upper limit value is made by adjusting the one get-on and get-off time according to the number of users. Moreover, when a traffic congestion is occurring after the section, it takes time to pass through the traffic congestion, the in-vehicle device 20 subtracts the maximum get-on and get-off time according to the degree of the traffic congestion. Further, in cases where a delay has occurred, if the number of times of stop is increased, the delay will increase, and hence, the in-vehicle device 20 subtracts the maximum get-on and get-off time according to the degree of the delay. Here, note that when the maximum get-on and get-off time becomes less than the one get-on and get-off time due to the congestion or delay, the upper limit is set to 0.

In step S40, the in-vehicle device 20 determines whether the upper limit value is 0. When an affirmative determination is made in step S40, the in-vehicle device 20 ends the processing of FIG. 6. That is, the in-vehicle device 20 stops the vehicle at the next stop 4 without making a temporary stop according to the desired location of the users.

When a negative determination is made in step S40, the in-vehicle device 20 proceeds to step S50, and determines a stop location based on the desired location information, the priority information, the traffic information, the number of passengers, and the delay condition, which have been obtained in step S20. For example, with respect to the desired locations indicated by the plurality of pieces of desired location information, the in-vehicle device 20 makes the desired locations into groups, the number of which is equal to or less than the upper limit value, each group being formed such that those of the desired locations which are close to each other are collected as a group. That is, the in-vehicle device 20 makes the desired locations into one group when the upper limit value is 1, but divides the desired locations into a plurality of groups when the upper limit value is 2 or more. Then, the in-vehicle device 20 determines each stop location such that the distance of each stop location from each desired location within each group becomes short, by taking an appropriate measure such as averaging the distances of the individual desired locations for each group. Here, note that priorities corresponding to children, elderly people, disability level, etc., may have been set for each user at each desired location, and the stop location may be determined based on priority information indicating the priority of the user at each desired location such that the distance of the stop location from the desired location having a higher priority is shorter.

In step S60, the in-vehicle device 20 transmits stop location information indicating the stop location determined in step S50 to the management server 30 and the user terminals 50. Thus, the user terminals 50 that have received the stop location information present the stop location to the users.

In addition, in step S70, the in-vehicle device 20 determines whether a presentation timing for the stop location has been reached. When an affirmative determination is made in step S70, the in-vehicle device 20 proceeds to step S80, and presents the stop location to the users in the vehicle. For example, when the vehicle 2 stops at a stop location immediately before the current stop location and then starts, the stop location determined in step S50 as the next stop location is displayed on the display device in the vehicle, or outputted by voice in a voice message thereby to be presented to the users in the vehicle.

The in-vehicle device 20 controls, separately from the processing in FIG. 6, the traveling device 22 based on the stop location determined in step S50, and stops the vehicle when the vehicle arrives at the stop location. Here, note that in cases where the vehicle 2 is not an autonomous or self-driving vehicle, the in-vehicle device 20 presents the stop location to the driver thereof, so that the driver stops the vehicle at the stop location, in step S60.

Figure 7:
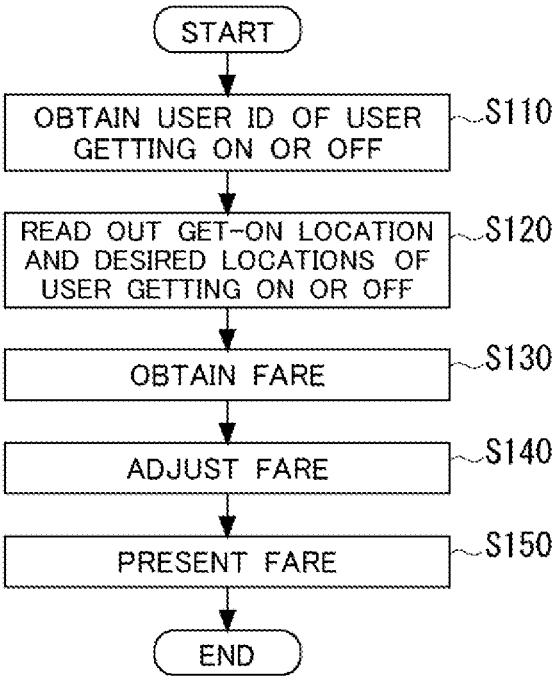
FIG. 7 is a view illustrating processing in which the in-vehicle device calculates a fare when a user gets off the vehicle.

When the vehicle 2 is stopped and the door is opened for a user to get on or off, the in-vehicle device 20 starts the processing of FIG. 7. FIG. 7 is a view illustrating the processing of calculating a fare by the in-vehicle device 20 when a user gets off the vehicle.

In step S110, the in-vehicle device 20 obtains identification information (user ID) of the user who gets on or off the vehicle by reading an IC chip of the user. For the user who gets on the vehicle, information indicating the stop location at the time of getting on (get-on location) and the user ID are stored in the storage unit 202 in association with each other. The user ID obtained when the user gets on or off the vehicle may be the same as or different from the user ID that are obtained together with the desired location information. Here, note that in cases where they are different from each other, the user ID obtained at the time of getting on or off and the user ID obtained together with the desired location information for the same user are registered in the storage unit 202 in association with each other.

In step S120, the in-vehicle device 20 reads out from the storage unit 202 the get-on location and the desired locations corresponding to the user ID of the user who gets off the vehicle.

In step S130, the in-vehicle device 20 obtains the fare of the user according to the distance from the get-on location read out in step S120 to the get-off location (current stop location). In cases where fares are set in a data table or the like in accordance with each pair of a get-on location and a get-off location, the fare of the user may be obtained in accordance with the one set in the data table or the like.

In step S140, the in-vehicle device 20 adjusts the fare obtained in step S130 based on a distance (separation distance) between the desired get-off location read out in step S120 and an actual get-off location or a distance (separation distance) between the desired get-on location and an actual get-on location. Since a user having a large separation distance cannot get on or off at a desired location and will move excessively, the fare of the user is, for example, subtracted in accordance with the separation distance as a compensation for the excessive movement. Here, note that in cases where the separation distance is equal to or less than a predetermined threshold value, the fare may not be adjusted. In addition, the adjustment of the fare is not limited to the subtraction of the fare, but an incentive may be added. For example, the in-vehicle device 20 may calculate the score of the incentive to be issued to the user based on the distance between the desired location desired by the user and the stop location. That is, when the separation distance is large, the score of the incentive to be given is made high, whereas when the separation distance is small, the score of the incentive is made low. Here, the incentive is, for example, a point, a coupon or the like that can be exchanged with a product or a service. Also, the incentive may be electronic information with a defined monetary value, such as electronic money. In the present embodiment, the amount of incentive is indicated by a score, and the amount of incentive to be issued is calculated according to the size of the separation distance. In this case, the monetary value may be determined according to the score, such as 1 point=1 yen.

In step S150, the in-vehicle device 20 presents the fare adjusted in step S140 to the user. For example, the in-vehicle device 20 displays the fare on a display device provided near an exit of the vehicle, and transmits the fare to the user terminal 50 to present the fare to the user. Thus, the in-vehicle device 20 presents the subtracted fare in the case of subtracting the fare in step S140, and presents the fare obtained in step S130 and the point of the incentive issued in step S140 in the case of adding the incentive.

As described above, in the present embodiment, it is possible to determine a stop location of the vehicle so as to be closer to each desired location based on a plurality of pieces of desired location information by a plurality of users, thereby improving the convenience of the users.

Second Embodiment

In the above-mentioned first embodiment, the in-vehicle device 20 performs the determination of stop locations and the calculation of fares, but in this second embodiment, a management server 30 performs the same functions. Here, note that the other configurations of the second embodiment are the same as those of the above-mentioned first embodiment, and hence, the same or like elements are denoted by the same reference numerals, and the repeated description thereof will be omitted.

Figure 8:
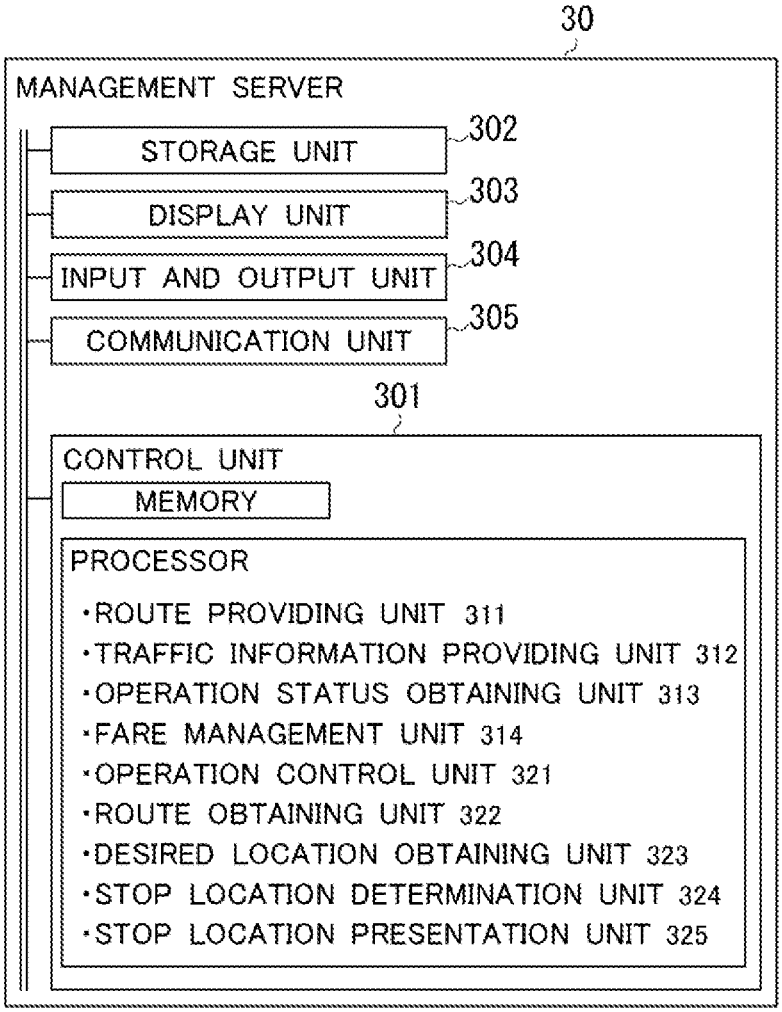
FIG. 8 is a schematic configuration diagram of a management server according to a second embodiment.

FIG. 8 is a schematic configuration diagram of the management server 30 according to the present embodiment. As illustrated in FIG. 8, in the management server 30 of the present embodiment, the control unit 301 functions as functional units such as a driving control unit 321, a route obtaining unit 322, a desired location obtaining unit 323, a vehicle stop location determination unit 324, a vehicle stop location presentation unit 325, and so on.

The driving control unit 321, the route obtaining unit 322, the desired location obtaining unit 323, the vehicle stop location determination unit 324, and the vehicle stop location presentation unit 325 have the same functions as those of the driving control unit 211, the route obtaining unit 212, the desired location obtaining unit 213, the vehicle stop location determination unit 214, and the vehicle stop location presentation unit 215 described above.

Figure 9:
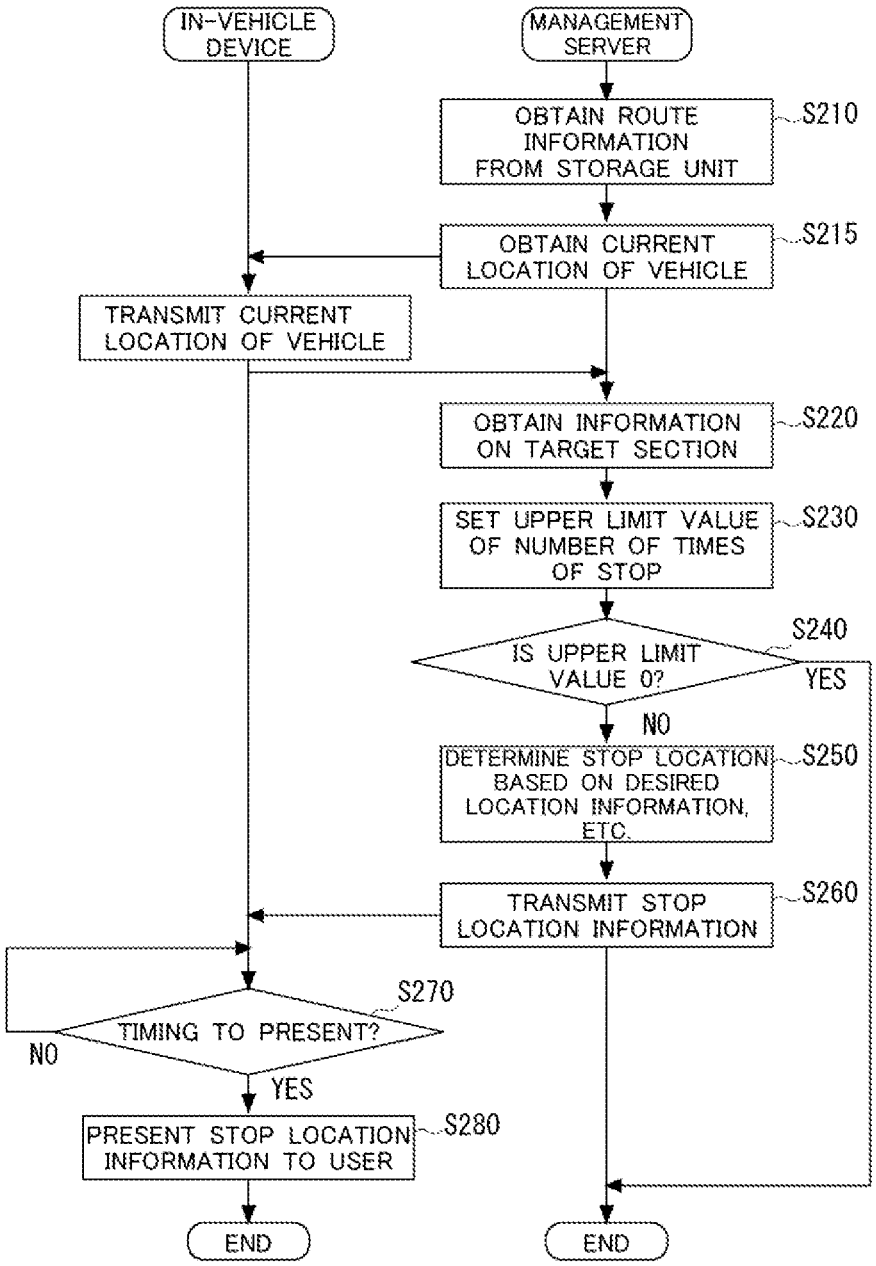
FIG. 9 is a view illustrating a flow of a control method performed for determining a stop location by an in-vehicle device and a management server according to a second embodiment.

FIG. 9 is a view illustrating a flow of a control method carried out by the in-vehicle device 20 and the management server 30 for determining a stop location. The in-vehicle device 20 and the management server 30 repeatedly perform the processing of FIG. 9 by executing a control program in a periodical manner.

In step S210, the management server 30 obtains route information indicating an operation route of a vehicle 2 from the storage unit 302.

In step S215, the management server 30 obtains information on the current location of the vehicle 2 from the in-vehicle device 20 of the vehicle 2.

In step S220, the management server 30 obtains route information, desired location information, priority information, traffic information, the number of passengers, and the condition of delay, of a section in which a stop location is determined (target section). Here, the target section is, for example, a section from the next stop 4, which has been obtained based on the current location of the vehicle 2 obtained in step S215, to the following next stop 4. Also, the target section may be a range of the operation route divided by a predetermined condition, such as a section in which the vehicle will travel from 10 minutes after to 20 minutes after, or a section from the current location to a forward location from 5 km to 10 km ahead. Here, note that the desired location information has been received at any time from the user terminal 50 of each user and held in the storage unit 302 separately from the processing of FIG. 9, so that it is obtained from the storage unit 302 in step S220.

In step S230, the management server 30 determines the upper limit value of the number of times of stop in the target section that has been set as the processing target in step S220.

In step S240, the management server 30 determines whether the upper limit value is 0. When an affirmative determination is made in step S240, the management server 30 ends the processing of FIG. 9. That is, the management server 30 stops the vehicle at the next stop 4 without making a temporary stop according to the desired location of each user.

When a negative determination is made in step S240, the management server 30 proceeds to step S250, and determines a stop location based on the desired location information, the priority information, the traffic information, the number of passengers, and the delay condition, which have been obtained in step S220. For example, with respect to the desired locations indicated by the plurality of pieces of desired location information, the management server 30 makes the desired locations into groups, the number of which is equal to or less than the upper limit value, each group being formed such that those of the desired locations which are close to each other are collected as a group. That is, the management server 30 makes the desired locations into one group when the upper limit value is 1, but divides the desired locations into a plurality of groups when the upper limit value is 2 or more. Then, the management server 30 determines each stop location such that the distance of each stop location from each desired location within each group becomes short, by taking an appropriate measure such as averaging the distances of the individual desired locations for each group. Here, note that priorities corresponding to children, elderly people, disability level, etc., may have been set for each user at each desired location, and the stop location may be determined based on priority information indicating the priority of the user at each desired location such that the distance of the stop location from the desired location having a higher priority is shorter.

In step S260, the management server 30 transmits stop location information indicating the stop location determined in step S250 to the in-vehicle device 20 and the user terminals 50. Thus, the user terminals 50, which have received the stop location information, present the stop location to the users.

In addition, in step S270, the in-vehicle device 20 determines whether a presentation timing for the stop location has been reached. For example, when the vehicle 2 stops at a stop location immediately before the current stop location and then starts, the stop location determined in step S250 as the next stop location is displayed on the display device in the vehicle, or outputted by voice in a voice message thereby to be presented to the users in the vehicle.

The in-vehicle device 20 controls the traveling device 22 based on the stop location information received from the management server 30 in the same manner as in the above-mentioned first embodiment, so that the vehicle is stopped when having arrived at the stop location indicated by the stop location information. Here, note that in cases where the vehicle 2 is not an autonomous or self-driving vehicle, the in-vehicle device 20 presents the stop location to the driver thereof based on the stop location information received from the management server 30, so that the driver stops the vehicle at the stop location.

Figure 10:
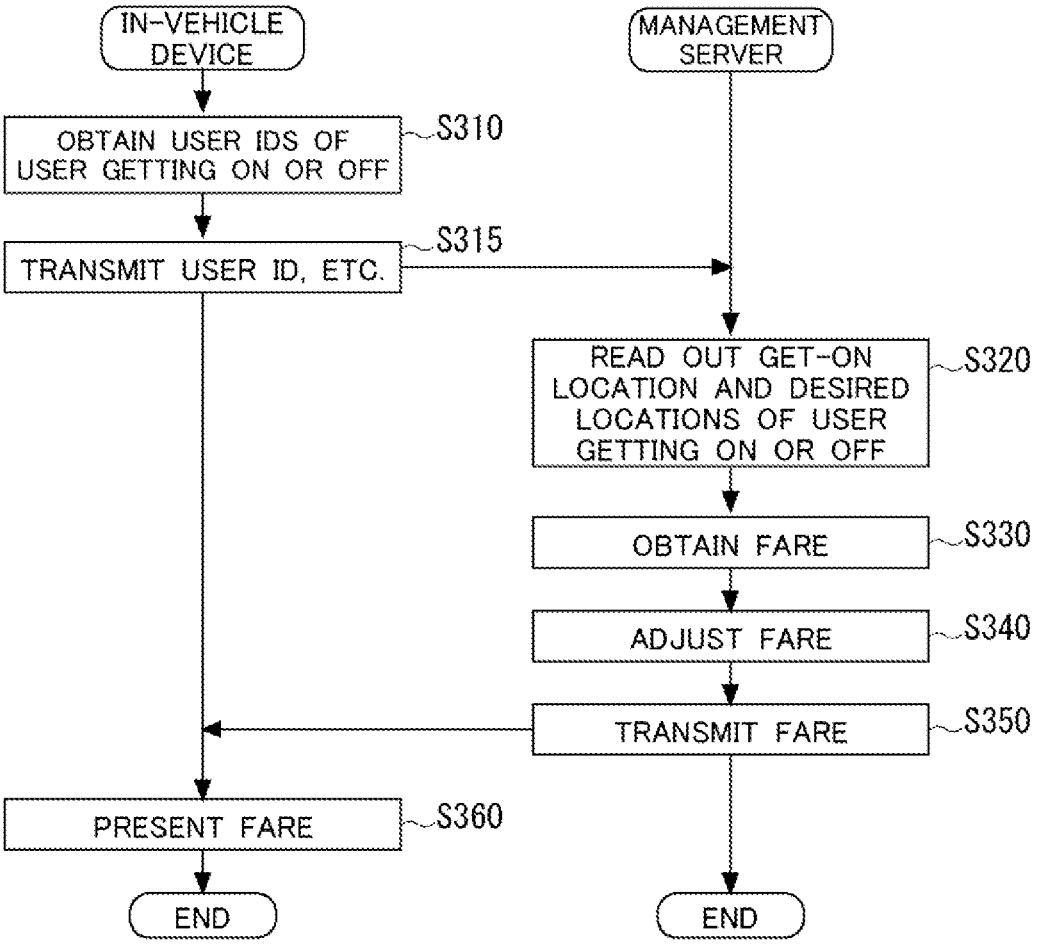
FIG. 10 is a view illustrating processing in which the in-vehicle device and the management server perform fare calculation when a user gets off a vehicle.

When the vehicle 2 is stopped and the door is opened for a user to get on or off, the in-vehicle device 20 starts the processing of FIG. 10. FIG. 10 is a view illustrating the processing related to the calculation of a fare, which is performed by the in-vehicle device 20 and the management server 30 when a user gets off the vehicle.

In step S310, the in-vehicle device 20 obtains identification information (user ID) of a user who gets on or off the vehicle by reading an IC chip of the user.

In step S315, the in-vehicle device 20 transmits the user ID obtained in step S310 to the management server 30 together with information indicating the type of getting on or getting off (type information) and information indicating the current stop location. The management server 30 stores, in the storage unit 302, information indicating the stop location (get-on location) at the time of getting on and the user ID in association with each other.

In step S320, the management server 30 reads out from the storage unit 202 the get-on location and the desired locations corresponding to the user ID of the user who gets off the vehicle.

In step S330, the management server 30 obtains the fare of the user according to the distance from the get-on location read out in step S320 to the get-off location (current stop location). In cases where fares are set in a data table or the like in accordance with each pair of a get-on location and a get-off location, the fare of the user may be obtained in accordance with the one set in the data table or the like.

In step S340, the management server 30 adjusts the fare obtained in step S330 according to a distance (separation distance) between the desired get-off location read out in step S320 and an actual get-off location or a distance (separation distance) between the desired get-on location and an actual get-on location. Note that the adjustment of the fare is not limited to the subtraction of the fare, but an incentive may be added.

In step S350, the management server 30 transmits information indicating the fare adjusted in step S340 to the in-vehicle device 20 and the user terminal 50. The in-vehicle device 20, which has received the information indicating the fare, presents the fare to the user, for example, by displaying the fare on a display device provided near an exit of the vehicle (step S360). In addition, the user terminal 50 receives the information indicating the fare, displays the fare on the display unit, and stores the fare in the memory. Here, note that in cases where the incentive is added, the management server 30 transmits information including the fare obtained in step S330 and the score of the incentive issued in step S340 to the in-vehicle device 20 and the user terminal 50.

As described above, in the present embodiment, it is possible to determine a stop location of the vehicle so as to be closer to each desired location based on a plurality of pieces of desired location information by a plurality of users, thereby improving the convenience of the users.

The control methods described in the above embodiments are each performed by a processor of a computer reading out a computer program. Such a computer program may be provided to the computer by a non-transitory computer readable storage medium that can be connected to a system bus of the computer, or may be provided to the computer through a network. The non-transitory computer readable storage medium is, for example, any type of disk such as a magnetic disk (a floppy (registered trademark) disk, a hard disk drive (HDD), etc.), an optical disk (a CD-ROM, a DVD disk, a Blu-ray disc, etc.), or the like. In addition, the non-transitory computer readable storage medium also includes a read-only memory (ROM), a random access memory (RAM), an EPROM, an EEPROM, a magnetic card, a flash memory, an optical card, and any type of medium suitable for storing electronic instructions.

What is claimed is:

1. An information processing apparatus with a controller comprising at least one processor configured to perform:

obtaining route information indicating an operation route of a vehicle utilized by a plurality of users;

obtaining desired location information indicating respective desired locations at which the plurality of users desire to get on the vehicle or respective desired locations at which the plurality of users desire to get off the vehicle;

determining a stop location at which the vehicle stops for the users to get on or off the vehicle, based on a plurality of pieces of the desired location information by the plurality of users and the route information, wherein the stop location minimizes an average of distances between the stop location and the respective desired locations for the users to get on or off the vehicle; and presenting, to the users, stop location information indicating the determined stop location.

2. The information processing apparatus as set forth in claim 1, wherein the controller classifies a plurality of the desired locations into groups, based on mutual distances between the desired locations, and determines one stop location for each group, wherein a quantity of the groups does not exceed an upper limit value.

3. The information processing apparatus as set forth in claim 2, wherein the controller determines the upper limit value based on a number of users utilizing the vehicle, a road condition of the operation route, or a delay condition with respect to an operation schedule of the vehicle, in addition to the route information and the plurality of pieces of the desired location information.

4. The information processing apparatus as set forth in claim 1, wherein when a first user, who is one of the plurality of users, desires to get on the vehicle, the controller obtains, from a user terminal of the first user, starting point information indicating a starting point from which the first user goes to the vehicle in order to get on the vehicle, and obtains a location on the operation route closest to the starting point as a desired location of the first user.

5. The information processing apparatus as set forth in claim 1, wherein when a second user, who is one of the plurality of users, desires to get off the vehicle, the controller obtains, from a user terminal of the second user, destination information indicating a destination point to which the second user goes after getting off the vehicle, and obtains a location on the operation route closest to the destination point as a desired location of the second user.

6. The information processing apparatus as set forth in claim 1, wherein the controller sets a priority to each of the desired locations indicated by the plurality of pieces of the desired location information, and determines one of the stop locations based on the priority in addition to the route information and the plurality of pieces of the desired location information.

7. The information processing apparatus as set forth in claim 1, wherein the controller performs a calculation of a fare of a third user, who is one of the plurality of users, based on a distance from a get-on location at which the third user has gotten on the vehicle to a get-off location at which the third user has gotten off the vehicle.

8. The information processing apparatus as set forth in claim 7, wherein the controller adjusts the fare in accordance with a distance between the desired location desired by the third user and the stop location.

9. The information processing apparatus as set forth in claim 1, wherein the controller calculates a score of an incentive to be issued to a fourth user, who is one of the plurality of users, based on a distance between the desired location desired by the fourth user and the stop location.

10. An operation management system comprising:

an in-vehicle device mounted on a vehicle; and a management server configured to manage an operation of the vehicle by communicating with the in-vehicle device;

wherein the in-vehicle device or the management server includes a controller comprising at least one processor configured to performs:

obtaining route information indicating an operation route of the vehicle utilized by a plurality of users;

obtaining desired location information indicating respective desired locations at which the plurality of users desire to get on the vehicle or respective desired locations at which the plurality of users desire to get off the vehicle;

determining a stop location at which the vehicle stops for the users to get on or off the vehicle, based on a plurality of pieces of the desired location information by the plurality of users and the route information, wherein the stop location minimizes an average of distances between the stop location and the respective desired locations for the users to get on or off the vehicle; and presenting, to the users, stop location information indicating the determined stop location.

11. The operation management system as set forth in claim 10, wherein the controller classifies a plurality of the desired locations into groups, based on mutual distances between the desired locations, and determines one stop location for each group, wherein a quantity of the groups does not exceed an upper limit value.

12. The operation management system as set forth in claim 11, wherein the controller determines the upper limit value based on a number of users utilizing the vehicle, a road condition of the operation route, or a delay condition with respect to an operation schedule of the vehicle, in addition to the route information and the plurality of pieces of desired location information.

13. The operation management system as set forth in claim 10, wherein when a first user, who is one of the plurality of users, desires to get on the vehicle, the controller obtains, from a user terminal of the first user, starting point information indicating a starting point from which the first user goes to the vehicle in order to get on the vehicle, and obtains a location on the operation route closest to the starting point as a desired location of the first user.

14. The operation management system as set forth in claim 10, wherein when a second user, who is one of the plurality of users, desires to get off the vehicle, the controller obtains, from a user terminal of the second user, destination information indicating a destination point to which the second user goes after getting off the vehicle, and obtains a location on the operation route closest to the destination point as a desired location of the second user.

15. The operation management system as set forth in claim 10, wherein the controller sets a priority to each of the desired locations indicated by the plurality of pieces of the desired location information, and determines one of the stop locations based on the priority in addition to the route information and the plurality of pieces of the desired location information.

16. The operation management system as set forth in claim 10, wherein the controller performs a calculation of a fare of a third user, who is one of the plurality of users, based on a distance from a get-on location at which the third user has gotten on the vehicle to a get-off location at which the third user has gotten off the vehicle.

17. The operation management system as set forth in claim 16, wherein the controller adjusts the fare in accordance with a distance between the desired location desired by the third user and the stop location.

18. The operation management system as set forth in claim 10, wherein the controller calculates a score of an incentive to be issued to a fourth user, who is one of the plurality of users, based on a distance between the desired location desired by the fourth user and the stop location.

19. A non-transitory storage medium having a program stored therein for causing a computer to perform:

obtaining route information indicating an operation route of a vehicle utilized by a plurality of users;

obtaining desired location information indicating respective desired locations at which the plurality of users desire to get on the vehicle or respective desired locations at which the plurality of users desire to get off the vehicle;

determining a stop location at which the vehicle stops for the users to get on or off the vehicle, based on a plurality of pieces of the desired location information by the plurality of users and the route information, wherein the stop location minimizes an average of distances between the stop location and the respective desired locations for the users to get on or off the vehicle; and presenting, to the users, stop location information indicating the determined stop location.

20. The non-transitory storage medium as set forth in claim 19, configured to further cause the computer to perform classifying a plurality of the desired locations into groups, based on mutual distances between the desired locations, and determining one stop location for each group, wherein a quantity of the groups does not exceed an upper limit value.

* * * * *